US010370817B2

(12) United States Patent
Yamashita

(10) Patent No.: US 10,370,817 B2
(45) Date of Patent: Aug. 6, 2019

(54) BOOM FOR CONSTRUCTION MACHINE

(71) Applicant: Hitachi Construction Machinery Co., Ltd., Taito-ku, Tokyo (JP)

(72) Inventor: Satoshi Yamashita, Nagareyama (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 339 days.

(21) Appl. No.: 15/122,513

(22) PCT Filed: Jun. 4, 2015

(86) PCT No.: PCT/JP2015/066242
§ 371 (c)(1),
(2) Date: Aug. 30, 2016

(87) PCT Pub. No.: WO2015/186800
PCT Pub. Date: Dec. 10, 2015

(65) Prior Publication Data

US 2017/0067224 A1 Mar. 9, 2017

(30) Foreign Application Priority Data

Jun. 5, 2014 (JP) ..... 2014-116824

(51) Int. Cl.
*E02F 3/38* (2006.01)
*E02F 3/32* (2006.01)

(52) U.S. Cl.
CPC . *E02F 3/38* (2013.01); *E02F 3/32* (2013.01)

(58) Field of Classification Search
CPC ... E02F 3/38; E02F 3/382; E02F 3/384; E02F 9/14; Y10S 414/131
(Continued)

(56) References Cited

U.S. PATENT DOCUMENTS 4,392,314 A * 7/1983 Albrecht ..... E02F 3/38 29/463
2002/0170212 A1* 11/2002 Sasaki ..... E02F 3/38 37/466

(Continued)

FOREIGN PATENT DOCUMENTS

CN 102029457 B 10/2012
EP 2 700 752 A1 2/2014

(Continued)

OTHER PUBLICATIONS

International Search Report (PCT/ISA/220 & PCT/ISA/210) issued in PCT Application No. PCT/JP2015/066242 dated Jun. 30, 2015 with English translation (seven pages).

(Continued)

*Primary Examiner* — Saul Rodriguez
*Assistant Examiner* — Brendan P Tighe
(74) *Attorney, Agent, or Firm* — Crowell & Moring LLP

(57) ABSTRACT

A single different-thickness plate (18) is formed by performing double-side welding from both sides in a plate thickness direction of a first front lower plate (17A) having a plate thickness equal to a plate thickness of a lower joining plate (33F) of an arm-side mounting member (33) and a second front lower plate (17B) having a plate thickness equal to a plate thickness of a third front lower plate (17C). As a result, one-side welding can be performed by using a backing material (23) from an outer side of a box-shaped structural body (12) to the lower joining plate (33F) of the arm-side mounting member (33) and to the first front lower plate (17A) constituting the different-thickness plate (18). On the other hand, one-side welding can be performed by using a backing material (26) from the outer side of the box-shaped structural body (12) to the third front lower plate (17C) joined on lower end sides of left and right side plates (13), (Continued)

(13'), and to the second front lower plate (17B) constituting the different-thickness plate (18).

1 Claim, 10 Drawing Sheets

(58) Field of Classification Search
USPC ..... 414/543, 680, 686, 691, 694, 727
See application file for complete search history.

(56) References Cited

U.S. PATENT DOCUMENTS

| | | | | |
|---|---|---|---|---|
| 2013/0343854 | A1* | 12/2013 | Sugaya | E02F 3/38 414/727 |
| 2014/0010624 | A1* | 1/2014 | Sugaya | E02F 3/38 414/727 |
| 2014/0056677 | A1* | 2/2014 | Takahashi | E02F 3/38 414/727 |
| 2014/0334906 | A1* | 11/2014 | Takahashi | E02F 3/38 414/727 |

FOREIGN PATENT DOCUMENTS

| | | | | |
|---|---|---|---|---|
| JP | 2005-169410 | A | 6/2005 | |
| JP | 2009-62713 | A | 3/2009 | |
| JP | 2012-241422 | A | 12/2012 | |
| JP | 2012-241424 | A | 12/2012 | |
| JP | 2012241424 | A * | 12/2012 | |
| WO | WO 92/05907 | A2 | 4/1992 | |
| WO | WO 2012/144037 | A1 | 10/2012 | |
| WO | WO-2012144037 | A1 * | 10/2012 | E02F 3/38 |
| WO | WO-2012157675 | A1 * | 11/2012 | E02F 3/38 |
| WO | WO-2013121969 | A1 * | 8/2013 | E02F 3/38 |

OTHER PUBLICATIONS

Japanese-language Written Opinion (PCT/ISA/237) issued in PCT Application No. PCT/JP2015/066242 dated Jun. 30, 2015 (three pages).

Extended European Search Report issued in counterpart European Patent Application No. 15802899.3 dated Dec. 18, 2017 (Eight (8) pages).

* cited by examiner

BOOM FOR CONSTRUCTION MACHINE

TECHNICAL FIELD

The present invention relates to a boom for a construction machine suitably used as a work arm in a working mechanism of a hydraulic excavator, for example.

BACKGROUND ART

In general, a working mechanism provided in a construction machine such as a hydraulic excavator and the like is constituted by a boom having a base end side liftably connected to a frame on a vehicle body side, an arm rotatably connected to a tip end side of the boom, a work tool such as an excavating bucket and the like rotatably connected to the tip end side of the arm, and a boom cylinder, an arm cylinder, and a work-tool cylinder for operating the boom, the arm, and the work tool.

Here, the boom constituting the working mechanism is formed of left and right side plates facing each other in a left-right direction and extending in a front-rear direction, an upper plate joined by welding to upper end sides of the left and right side plates, and a lower plate joined by welding to lower end sides of the left and right side plates. As a result, the boom is a box-shaped structural body formed of a cross section forming a square closed sectional structure, a foot-side mounting member is provided on a rear end side of this box-shaped structural body, and an arm-side mounting member is provided on a front end side. Therefore, the boom of the hydraulic excavator becomes a lengthy welded structure with the entire length of up to several meters or more and its weight also becomes large.

On the other hand, a boom in which the left and right side plates, the upper plate, and the lower plate are formed by joining a plurality of plate materials using butt welding, respectively, is proposed. This boom according to the prior art is constituted to be able to reduce a weight of the entire structure by setting a plate thickness of each plate material in accordance with required strength and by arranging the plate material with a small plate thickness within a range as wide as possible (Patent Document 1).

PRIOR ART DOCUMENT

Patent Document

Patent Document 1: WO2012/144037A1

SUMMARY OF THE INVENTION

Here, fatigue strength of a welded portion (stress with which the welded portion does not reach destruction when a stress repeatedly acts on the welded portion) formed by butt-welding of two plate materials will be considered. That is, when two plate materials are butt-welded, as compared with one-side welding which performs welding from one side in a plate-thickness direction by using a backing material, it is known that the fatigue strength of the welded portion is higher with double-side welding which performs welding from both sides in the plate-thickness direction. On the other hand, a case of butt-welding of two plate materials with different plate thicknesses and a case of butt-welding of two plate materials with the same plate thickness are compared. In this case, whether it is the double-side welding or the one-side welding by using the backing material, it is known that the fatigue strength of the welded portion is higher in the butt-welding of the two plate materials with the same plate thickness than the butt-welding of the two plate materials with the different plate thicknesses.

Subsequently, an order of the fatigue strength of the welded portion is considered. The fatigue strength is the highest in the case where the two plate materials with the same plate thickness are joined by double-side welding. The fatigue strength is the second highest in the case where the two plate materials with the different plate thicknesses are joined by double-side welding (slightly higher). The fatigue strength is the third highest (slightly lower) in the case where the two plate materials with the same plate thickness are joined by one-side welding using the backing material. On the other hand, the fatigue strength becomes the lowest in the case where the two plate materials with the different plate thicknesses are joined by the one-side welding using the backing materials.

On the other hand, in the case where a box-shaped structural body such as the boom used in the hydraulic excavator is manufactured, a lid for closing the assembled box-shaped structural body is needed, and the plate material corresponding to this lid is subjected to a welding work from an outer side of the box-shaped structural body (one-side welding) by using the backing material.

However, in the case where the plate thickness of the plate material corresponding to the lid and the plate thickness of the plate material to which this plate material is welded are different, the two plate materials with the different plate thicknesses are joined by one-side welding by using the backing material, which lowers the fatigue strength of the welded portion, as described above. As a result, there occurs a problem that durability of the box-shaped structural body lowers.

In view of the aforementioned problems with the conventional art, it is an object of the present invention to provide a boom for a construction machine which can improve fatigue strength of the box-shaped structural body and can improve workability when the plate material for closing the box-shaped structural body is welded.

In order to solve the aforementioned problem, the present invention is applied to a boom for a construction machine comprising: a box-shaped structural body formed of a cross section forming a square closed sectional structure by a left side plate and a right side plate facing each other at an interval in a left-right direction and extending in a front-rear direction, an upper plate joined to upper end sides of the left and right side plates by welding, and a lower plate joined to lower end sides of the left and right side plates by welding; a foot-side mounting member joined to rear ends of the left side plate, the right side plate, the upper plate, and the lower plate by welding, respectively, and provided to the box-shaped structural body; an arm-side mounting member having left and right joining plates to which front ends of the left and right side plates are joined by welding, respectively, and having upper and lower joining plates to which front ends of the upper plate and the lower plate are joined by welding, respectively, and provided to the box-shaped structural body; and the lower plate constituted by a first front lower plate joined to the lower joining plate of the arm-side mounting member by welding, a second front lower plate joined to a rear end of the first front lower plate by welding, a third front lower plate joined to a rear end of the second front lower plate by welding, and a rear lower plate made of one or a plurality of plate materials joined to a rear end of the third front lower plate.

A characteristic feature of the present invention is constituted such that the first front lower plate is made of a plate material having a plate thickness equal to the lower joining plate of the arm-side mounting member; the second front lower plate is made of a plate material having a plate thickness equal to the third front lower plate and having a plate thickness smaller than the first front lower plate; a backing material is provided on a rear end of the lower joining plate of the arm-side mounting member; a backing material is provided on a front end of the third front lower plate; the first front lower plate and the second front lower plate are made to abut and fully welded so as to form a single different-thickness plate; a front end of the first front lower plate constituting the different-thickness plate is joined to the lower joining plate of the arm-side mounting member and the backing material provided on the lower joining plate from an outer side of the box-shaped structural body by one-side welding; and the rear end of the second front lower plate constituting the different-thickness plate is joined to the front end of the third front lower plate and the backing material provided on the third front lower plate from the outer side of the box-shaped structural body by one-side welding.

With this arrangement, the different-thickness plate with high fatigue strength in which the first and second front lower plates are welded over the whole region of the plate thickness can be formed by making the first front lower plate and the second front lower plate with different plate thicknesses to abut and fully welded. Moreover, the plate thickness of the first front lower plate constituting the different-thickness plate is equal to the lower joining plate of the arm-side mounting member. Therefore, even in the case where the front end of the first front lower plate and the lower joining plate of the arm-side mounting member are one-side welded from the outer side by using the backing material, the fatigue strength of a welded portion between the first front lower plate and the lower joining plate of the arm-side mounting member can be improved. On the other hand, the plate thickness of the second front lower plate constituting the different-thickness plate is equal to the third front lower plate. Therefore, even in the case where the rear end of the second front lower plate and the front end of the third front lower plate are one-side welded from the outer side by using the backing material, the fatigue strength of the welded portion between the second front lower plate and the third front lower plate can be improved.

Accordingly, the first front lower plate and the lower joining plate of the arm-side mounting member constituting the different-thickness plate are double-side welded and the second front lower plate and the third lower plate constituting the different-thickness plate are one-side welded by using the backing material. As a result, the fatigue strength of the entire box-shaped structural body can be improved, and durability of the boom can be improved.

Moreover, the first front lower plate and the second front lower plate are formed as a single different-thickness plate by double-side welding performed in advance. Accordingly, a work of one-side welding of the first front lower plate and the lower joining plate of the arm-side mounting member constituting this different-thickness plate and a work of one-side welding of the second front lower plate and the third front lower plate constituting the different-thickness plate can be performed from the outer side of the box-shaped structural body. As a result, workability can be improved when the first and second front lower plates closing the box-shaped structural body are welded.

MODE FOR CARRYING OUT THE INVENTION

Hereinafter, a boom for a construction machine according to an embodiment of the present invention will be described in detail with reference to the attached drawings by taking a case where the boom for a construction machine is applied to the boom of a hydraulic excavator as an example.

Figure 1:
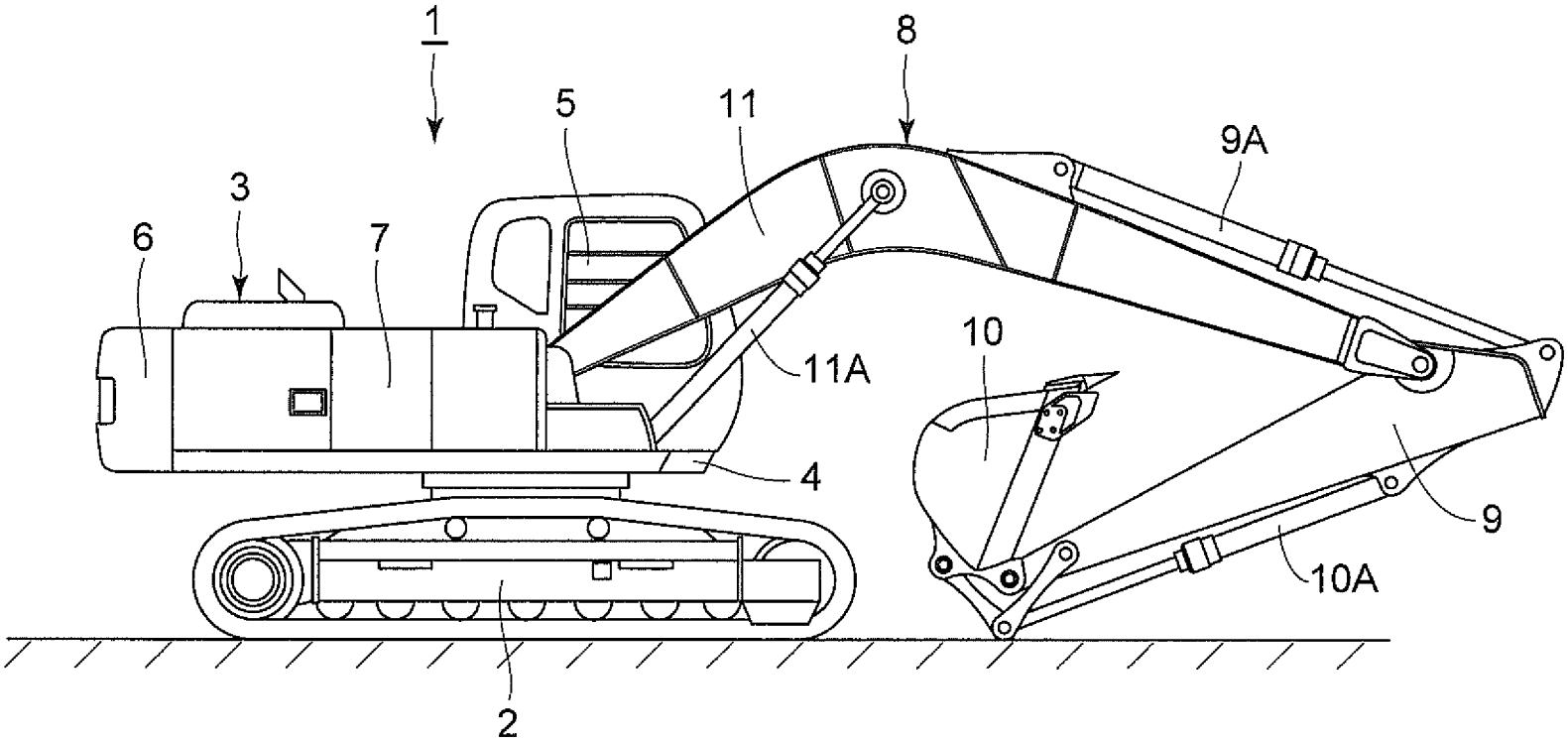
FIG. 1 is a front view showing a hydraulic excavator provided with a boom according to the embodiment of the present invention.
Figure 2:
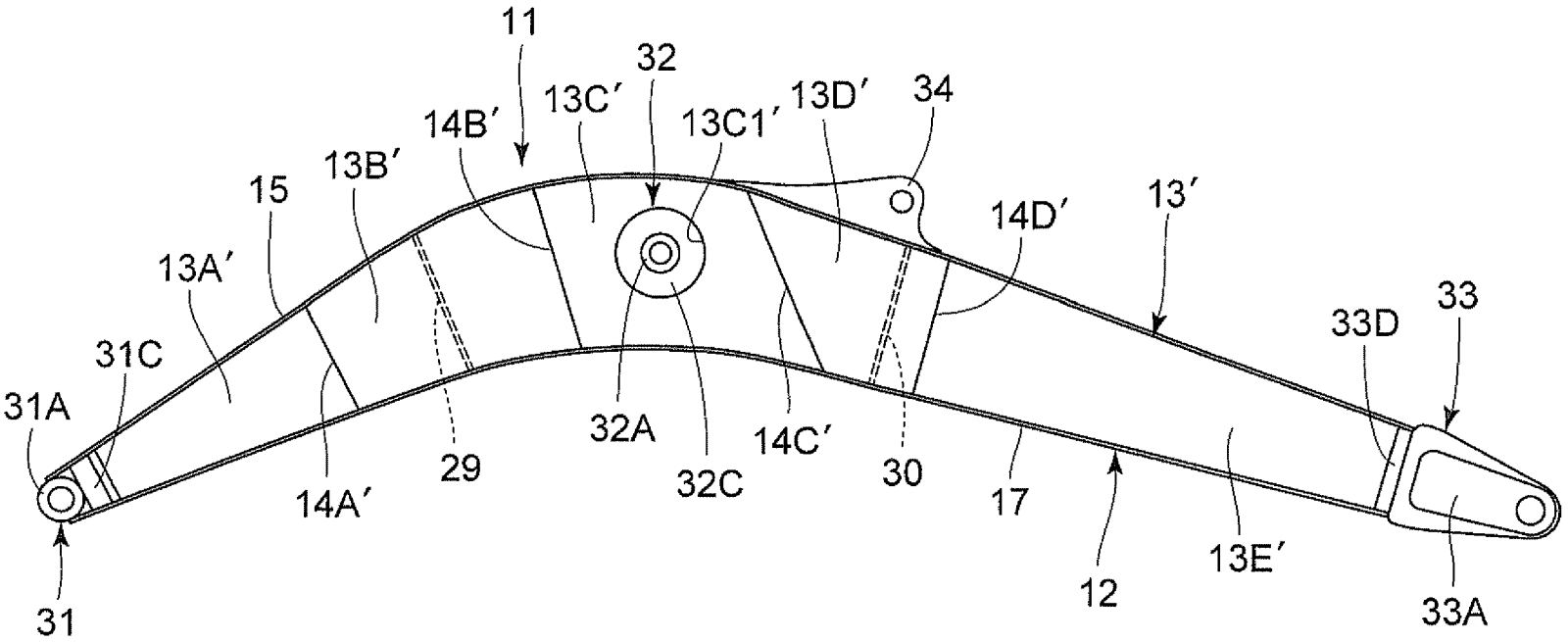
FIG. 2 is a front view showing the boom in FIG. 1 as a single unit.

In the figure, a hydraulic excavator 1 is a typical example of a construction machine. As shown in FIG. 1, this hydraulic excavator 1 is configured to include an automotive crawler-type lower traveling structure 2, an upper revolving structure 3 rotatably mounted on the lower traveling structure 2, and a working mechanism 8 which will be described later. The upper revolving structure 3 of the hydraulic excavator 1 constitutes a vehicle body of the construction machine together with the lower traveling structure 2. The upper revolving structure 3 is configured to include a revolving frame 4, a cab 5, a counterweight 6, a housing cover 7 and the like which will be described later.

The revolving frame 4 constitutes a frame of the upper revolving structure 3. In the revolving frame 4, on its front side thereof, the working mechanism 8 which will be described later is liftably mounted, and the counterweight 6 which will be described later is mounted on a rear side. The cab 5 is disposed on a left side of a front part of the revolving frame 4, and the cab 5 defines an operator's room therein. An operator's seat on which the operator is seated, an operation lever, a traveling lever or a pedal (none of them is shown) and the like are disposed in the cab 5.

The counterweight 6 is provided on a rear end side of the revolving frame 4. The counterweight 6 is detachably mounted on the rear end side of the revolving frame 4 so as to take a weight balance with respect to the working mechanism 8 on the front side.

The housing cover 7 installed upright on the revolving frame 4 is arranged between the cab 5 and the counterweight 6. The housing cover 7 is formed by using a plurality of metal panels each made of a thin steel plate and the like, for example, and defines a machine room (not shown) for accommodating an engine and the like therein.

The working mechanism 8 is liftably provided on the front part of the upper revolving structure 3. The working mechanism 8 is configured to include a boom 11 which will be described later, an arm 9 liftably mounted on a tip end side of the boom 11, and a bucket 10 as a work tool rotatably provided on the tip end side of the arm 9. The boom 11 of the working mechanism 8 is moved upward/downward by a boom cylinder 11A with respect to the revolving frame 4, and the arm 9 is moved upward/downward by an arm cylinder 9A on the tip end side of the boom 11. The bucket 10 as the work tool is rotationally moved upward/downward by a bucket cylinder 10A on the tip end side of the arm 9.

Next, the boom used in this embodiment will be described.

The boom 11 constitutes a work arm of the working mechanism 8. This boom 11 is moved upward/downward by the boom cylinder 11A with respect to the revolving frame 4. Here, the boom 11 is constituted by a lengthy box-shaped structural body 12 curved in a bow shape and extending in the front-rear direction (length direction of the boom 11), a foot-side mounting member 31 which will be described later provided on a rear end side of the box-shaped structural body 12, and an arm-side mounting member 33 which will be described later provided on a front end side of the box-shaped structural body 12.

Here, the box-shaped structural body 12 constituting an essential part of the boom 11 will be described.

As shown in FIG. 2 to FIG. 5, the box-shaped structural body 12 is formed of a left side plate 13 and a right side plate 13' facing each other at an interval in the left-right direction and extending in the front-rear direction, an upper plate 15 joined to an upper end side of each of the side plates 13 and 13' by welding, and a lower plate 17 joined to a lower end side of each of the side plates 13 and 13' by welding. This box-shaped structural body 12 has a cross section with a square closed sectional structure.

The left side plate 13, the right side plate 13', the upper plate 15, and the lower plate 17 are formed by using a plate material made of a high-tension steel, for example, so that a plate thickness of each of the plate materials can be made as thin as possible. Similarly, each of partition plates 29 and 30 which will be described later, the foot-side mounting member 31, a cylinder mounting boss member 32, the arm-side mounting member 33, and a cylinder bracket 34 are also formed by using a steel material made of similar high-tension steel.

Next, the left side plate 13 and the right side plate 13' constituting the box-shaped structural body 12 will be specifically explained.

That is, the left side plate 13 forms a left side surface of the box-shaped structural body 12, and the right side plate 13' forms a right side surface of the box-shaped structural body 12. Since the left side plate 13 and the right side plate 13' are both formed in the same shape, the left side plate 13 will be explained, while the right side plate 13' is given a dash (') to a reference numeral corresponding to the left side plate 13, and the explanation will be omitted. Further, the rear end side in the front-rear direction which is a length direction of the boom 11 corresponds to a rear part side (the revolving frame 4 side) of the boom 11 when seen from a vehicle rear of the hydraulic excavator 1, and the front end side in the front-rear direction corresponds to a front part side (the arm 9 side) of the boom 11 when seen from the vehicle rear of the hydraulic excavator 1.

Figure 3:
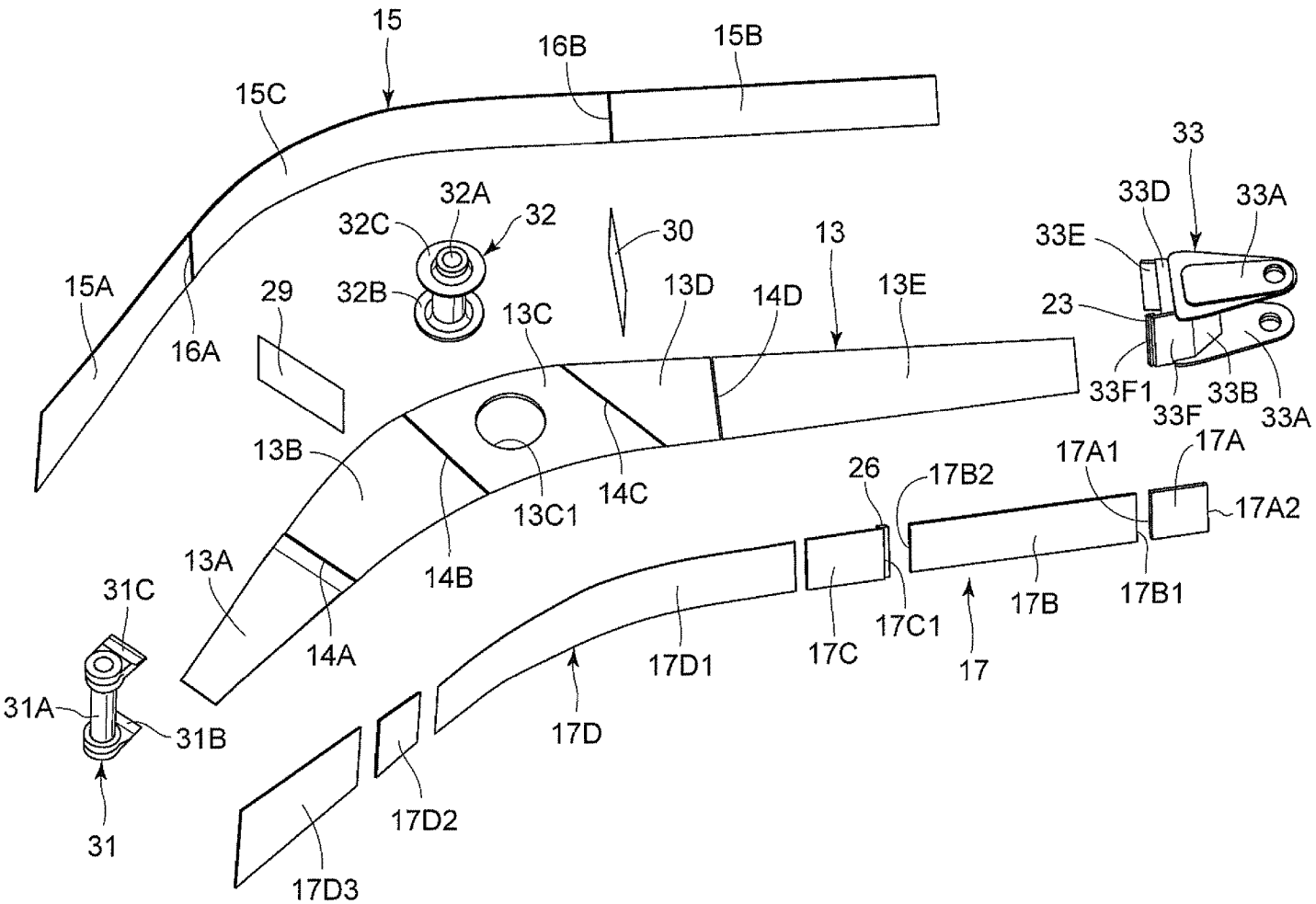
FIG. 3 is an exploded perspective view showing each plate material constituting the boom.

As shown in FIG. 3, the left side plate 13 is constituted by joining five plate materials in total consisting of a first side plate 13A located on the rear end side (the foot side of the boom 11) in its entire length, a second side plate 13B, a third side plate 13C, a fourth side plate 13D, and a fifth side plate 13E sequentially arranged on the front side thereof and having shapes different from each other.

The first side plate 13A located on the rearmost side in the front-rear direction is formed in a square shape whose width dimension in a vertical direction gradually increases from the rear side toward the front side by press-forming a flat plate material made of high-tension steel. The second side plate 13B is also formed in a square shape whose width dimension in the vertical direction gradually increases from the rear side toward the front side by press-forming the flat plate material made of high-tension steel.

The third side plate 13C located the closest to the center in the front-rear direction in the left side plate 13 is formed in a parallelogram shape by press-forming the flat plate material made of high-tension steel. Here, the both upper and lower end sides of the third side plate 13C are formed in an arch shape with predetermined curvature, respectively. Moreover, a circular punching hole 13C1 is formed in the third side plate 13C, and to the punching hole 13C1, a left annular flange portion 32B of the cylinder mounting boss member 32 which will be described later is joined by welding. On the other hand, the fourth side plate 13D is formed in a trapezoidal shape with its upper bottom longer than a lower bottom by press-forming the flat plate material made of high-tension steel.

The fifth side plate 13E located on the frontmost side (front end side) in the front-rear direction in the left side plate 13 is formed in a square shape whose width dimension in the vertical direction gradually decreases from the rear side toward the front side by press-forming the flat plate material made of high-tension steel. The fifth side plate 13E has the largest length dimension in the front-rear direction in the first side plate 13A to the fifth side plate 13E and its plate thickness is formed the smallest.

As shown in FIG. 3, the front end of the first side plate 13A is butt-welded to the rear end of the second side plate 13B, and the first side plate 13A and the second side plate 13B are joined along a welding line 14A. The front end of the second side plate 13B is butt-welded to the rear end of the third side plate 13C, and the second side plate 13B and the third side plate 13C are joined along a welding line 14B.

The front end of the third side plate 13C is butt-welded to the rear end of the fourth side plate 13D, and the third side plate 13C and the fourth side plate 13D are joined along a welding line 14C. Moreover, the front end of the fourth side plate 13D is butt-welded to the rear end of the fifth side plate 13E, and the fourth side plate 13D and the fifth side plate 13E are joined along a welding line 14D.

Figure 4:
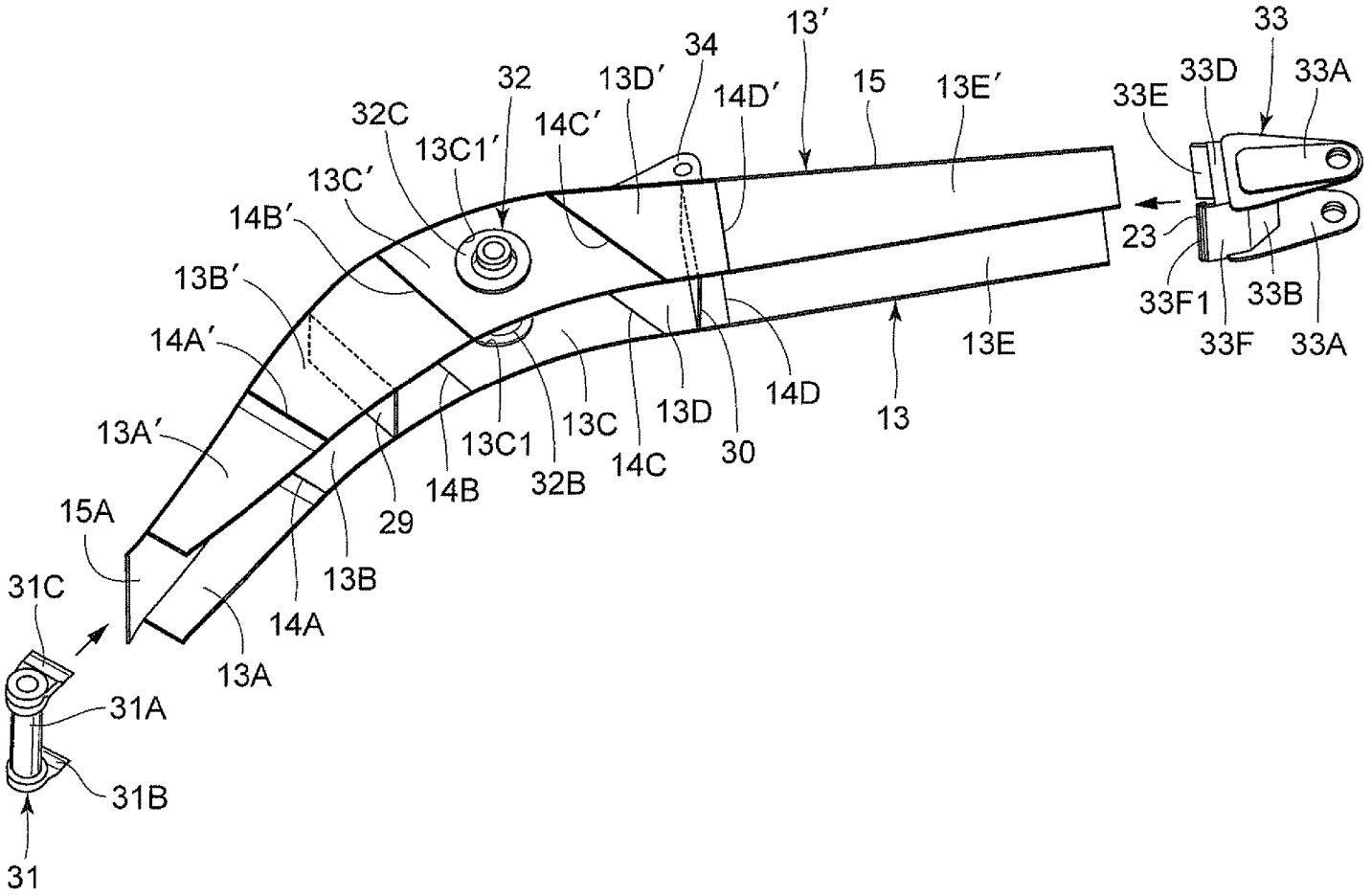
FIG. 4 is an exploded perspective view showing a state in which a foot-side mounting member and an arm-side mounting member are removed from left and right side plates and an upper plate.

On the other hand, as shown in FIG. 4, a first side plate 13A' and a second side plate 13B' constituting the right side plate 13' are joined along a welding line 14A', the second side plate 13B' and a third side plate 13C' are joined along a welding line 14B', the third side plate 13C' and a fourth side plate 13D' are joined along a welding line 14C', and the fourth side plate 13D' and a fifth side plate 13E' are joined along a welding line 14D'.

Here, in the first side plate 13A to the fifth side plate 13E constituting the left side plate 13, its load bearing becomes the largest in the first side plate 13A and the third side plate 13C, and a plate thickness t1*a* of the first side plate 13A and a plate thickness t1*c* of the third side plate 13C are set the largest. Thus, the plate thickness t1*a* of the first side plate 13A, a plate thickness t1*b* of the second side plate 13B, the plate thickness t1*c* of the third side plate 13C, a plate thickness t1*d* of the fourth side plate 13D, and a plate thickness t1*e* of the fifth side plate 13E are in a relation as in the following formula 1.

$$t1a=t1c>t1b=t1d>t1e \quad \text{[Formula 1]}$$

The plate thicknesses of the first side plate 13A' to the fifth side plate 13E' constituting the right side plate 13' also have the relation similar to the plate thicknesses of the first side plate 13A to the fifth side plate 13E constituting the left side plate 13.

Next, the upper plate 15 constituting the box-shaped structural body 12 will be specifically explained.

The upper plate 15 is joined to upper end sides of the left side plate 13 and the right side plate 13' by fillet welding. As shown in FIG. 3, the upper plate 15 is constituted by three plate materials in total consisting of a rear upper plate 15A located on a rear side in the front-rear direction of the entire length of the upper plate 15, a front upper plate 15B located on a front side in the front-rear direction, and an intermediate upper plate 15C arranged between the rear upper plate 15A and the front upper plate 15B. The intermediate upper plate 15C is arranged at a position covering the cylinder mounting boss member 32 which will be described later from above.

The rear upper plate 15A, the front upper plate 15B, and the intermediate upper plate 15C are formed in a square shape by press-forming the flat plate material made of high-tension steel, respectively, having shapes different from each other and extending in the front-rear direction. Regarding the length dimension, the rear upper plate 15A is the shortest, the intermediate upper plate 15C is the longest, and the front upper plate 15B is formed having a length in the middle of the both.

In the upper plate 15, since the cylinder bracket 34 which will be described later is joined to an outer side surface of the intermediate upper plate 15C, a plate thickness t2*c* of the intermediate upper plate 15C is the largest, a plate thickness t2*b* of the front upper plate 15B is the smallest, and a plate thickness t2*a* of the rear upper plate 15A is set having an intermediate plate thickness. Accordingly, the plate thickness t2*a* of the rear upper plate 15A, the plate thickness t2*b* of the front upper plate 15B, and the plate thickness t2*c* of the intermediate upper plate 15C are in a relation as in the following formula 2.

$$t2c>t2a>t2b \quad \text{[Formula 2]}$$

A rear end of the intermediate upper plate 15C is butt-welded to a front end of the rear upper plate 15A, and the intermediate upper plate 15C and the rear upper plate 15A are joined along a welding line 16A. A rear end of the front upper plate 15B is butt-welded to a front end of the intermediate upper plate 15C, and the front upper plate 15B and the intermediate upper plate 15C are joined along a welding line 16B.

In a state where the intermediate upper plate 15C is joined between the rear upper plate 15A and the front upper plate 15B, rolling process after plate-joining is performed on the upper plate 15. As a result, the upper plate 15 is curved as shown in FIG. 3. That is, the rear upper plate 15A and the intermediate upper plate 15C of the upper plate 15 are curved in a shape along an arc-shaped contour on the upper end sides of the left and right side plates 13 and 13'.

Next, the lower plate 17 constituting the box-shaped structural body 12 will be specifically explained.

The lower plate 17 is joined to lower end sides of the left side plate 13 and the right side plate 13' by welding. As shown in FIG. 3, the lower plate 17 is constituted by a first front lower plate 17A located on the front end side of the lower plate 17, a second front lower plate 17B located on the rear side of the first front lower plate 17A, a third front lower plate 17C located on the rear side of the second front lower plate 17B, and a rear lower plate 17D located on the rear side of the third front lower plate 17C. Moreover, the rear lower plate 17D is constituted by three plate materials of a first rear lower plate 17D1, a second rear lower plate 17D2 located on the rear side of the first rear lower plate 17D1, and a third rear lower plate 17D3 located on the rear side of the second rear lower plate 17D2. That is, the lower plate 17 is constituted by six plate materials in total.

The first front lower plate 17A, the second front lower plate 17B, and the third front lower plate 17C are formed in a square shape by press-forming a flat plate material made of high-tension steel, respectively, having shapes different from each other and extending in the front-rear direction. The length dimension of the first front lower plate 17A is set the shortest, and the length dimension of the second front lower plate 17B is set the longest. The length dimension of the third front lower plate 17C is set longer than the first front lower plate 17A and shorter than the second front lower plate 17B.

As shown in FIG. 6 to FIG. 10, a plate thickness t3*a* of the first front lower plate 17A is the largest and is set to the thickness equal to a plate thickness t4 of a lower joining plate 33F constituting the arm-side mounting member 33 which will be described later. On the other hand, a plate thickness t3*b* of the second front lower plate 17B and a plate thickness t3*c* of the third front lower plate 17C are set equal. Accordingly, the plate thickness t3*a* of the first front lower plate 17A, the plate thickness t3*b* of the second front lower plate 17B, the plate thickness t3*c* of the third front lower plate 17C, and the plate thickness t4 of the lower joining plate 33F are in a relation as in the following formula 3.

$$t3a=t4>t3b=t3c \quad \text{[Formula 3]}$$

Figure 5:
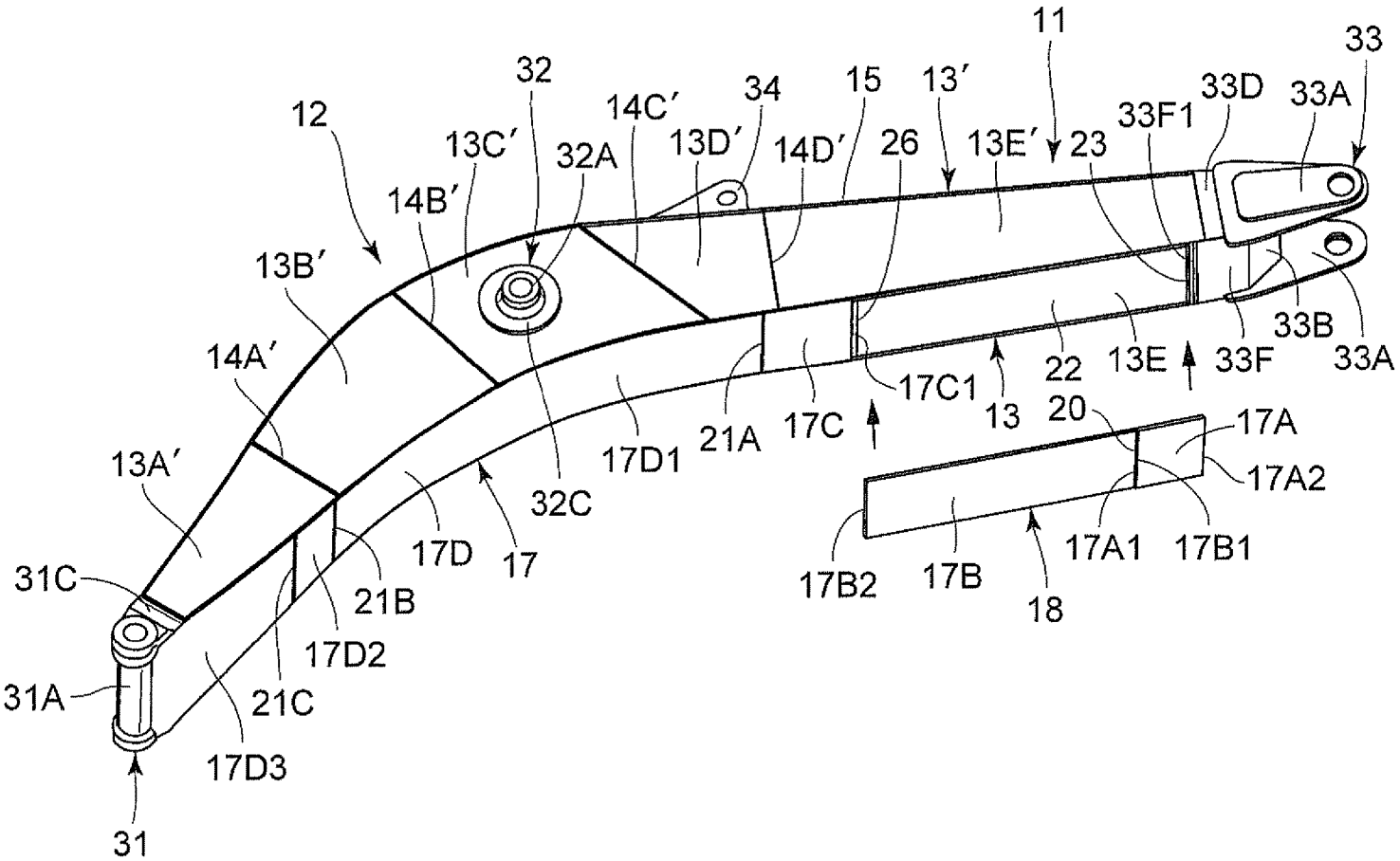
FIG. 5 is an exploded perspective view showing a state in which first and second front lower plates (different-thickness plates) are joined to the left and right side plates assembled on the upper plate.

Here, as shown in FIG. 5, a rear end 17A1 of the first front lower plate 17A and a front end 17B1 of the second front lower plate 17B are butt-welded in advance in a stage prior to joining to the lower end sides of the left and right side plates 13 and 13' assembled on the upper plate 15. As a result, a single different-thickness plate 18 with a front side made of the first front lower plate 17A and a rear side made of the second front lower plate 17B is formed.

Figure 7:
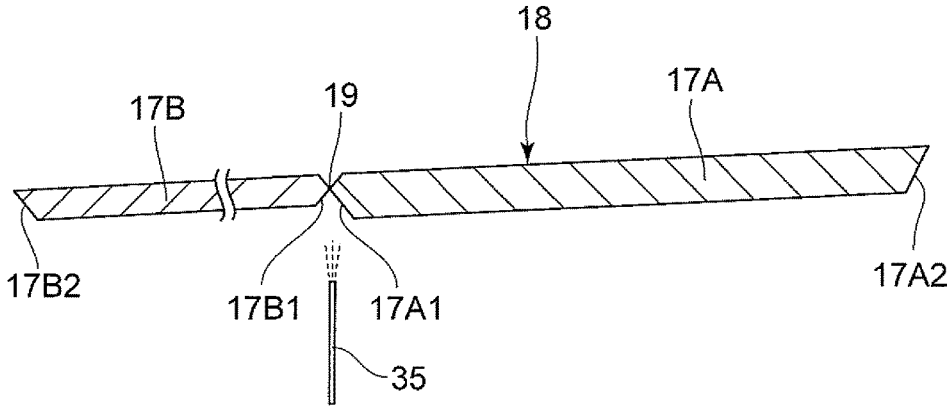
FIG. 7 is a sectional view showing an X-shaped groove between a rear end of the first front lower plate and a front end of the second front lower plate constituting the different-thickness plate.

As shown in FIG. 7, an X-shaped groove 19 for performing butt-welding from both sides in a plate thickness direction is formed between the rear end 17A1 of the first front lower plate 17A and the front end 17B1 of the second front lower plate 17B. Accordingly, the single different-thickness plate 18 in which the first front lower plate 17A and the second front lower plate 17B are joined by a welding bead 20 is formed by performing double-side welding from the both sides in the plate thickness direction at a position of this X-shaped groove 19. In this case, the rear end 17A1 of the first front lower plate 17A and the front end 17B1 of the second front lower plate 17B are joined in a state fully welded over the entire region of the plate thickness by the double-side welding performed from the both sides in the plate thickness direction by the X-shaped groove 19.

On the other hand, the first rear lower plate 17D1, the second rear lower plate 17D2, and the third rear lower plate 17D3 constituting the rear lower plate 17D are formed in a square shape by press-forming a flat plate material made of high-tension steel, having shapes different from each other and extending in the front-rear direction.

The length dimension of the first rear lower plate 17D1 is set the longest, and the length dimension of the second rear lower plate 17D2 is set the shortest. The length dimension of the third rear lower plate 17D3 is set shorter than the first rear lower plate 17D1 and longer than the second rear lower plate 17D2. On the other hand, a plate thickness t3*d* of the first rear lower plate 17D1 is the largest, and a plate thickness t3*e* of the second rear lower plate 17D2 and a plate thickness t3*f* of the third rear lower plate 17D3 are set equal. Accordingly, the plate thickness t3*d* of the first rear lower plate 17D1, the plate thickness t3*e* of the second rear lower plate 17D2, and the plate thickness t3*f* of the third rear lower plate 17D3 are in a relation as in the following formula 4.

$$t3d > t3e = t3f \quad \text{[Formula 4]}$$

As shown in FIG. 3, rolling process before plate-joining is performed on the first rear lower plate 17D1, and the first rear lower plate 17D1 is curved in a shape along an arc-shaped contour on the lower end side of the left side plate 13. As shown in FIG. 5, the front end of the first rear lower plate 17D1 is butt-welded to the rear end of the third front lower plate 17C, and the first rear lower plate 17D1 and the third front lower plate 17C are joined along a welding line 21A. The first rear lower plate 17D1 and the third front lower plate 17C joined to each other are joined by welding to each of the side plates 13 and 13' assembled and welded to the upper plate 15 so as to close the lower end side in an intermediate portion in the length direction.

The second rear lower plate 17D2 is arranged on the rear side from the first rear lower plate 17D1 and joined by welding to each of the side plates 13 and 13' so as to close the lower end sides thereof. At this time, the front end of the second rear lower plate 17D2 is butt-welded to the rear end of the first rear lower plate 17D1, and the second rear lower plate 17D2 and the first rear lower plate 17D1 are welded along a welding line 21B. Moreover, the third rear lower plate 17D3 is arranged on the rear side from the second rear lower plate 17D2 and joined by welding to each of the side plates 13 and 13' so as to close the lower end sides thereof. At this time, the front end of the third rear lower plate 17D3 is butt-welded to the rear end of the second rear lower plate 17D2, and the third rear lower plate 17D3 and the second rear lower plate 17D2 are joined along a welding line 21C. The rear end of the third rear lower plate 17D3 is joined by welding to a boss portion 31A of the foot-side mounting member 31 which will be described later.

Here, as shown in FIG. 5, when the boom 11 forming a box-shaped structure is formed, in a pre-stage for joining the lower plate 17 to the lower end side of each of the side plates 13 and 13' assembled on the upper plate 15, the foot-side mounting member 31 is joined to the rear end side of each of the side plates 13 and 13' and the upper plate 15, and the arm-side mounting member 33 is joined to the front end side of each of the side plates 13 and 13' and the upper plate 15. In this state, an opening portion 22 is formed between the lower joining plate 33F of the arm-side mounting member 33 and the third front lower plate 17C, and this opening portion 22 is closed by the different-thickness plate 18 which functions as a lid. That is, the lower end side of each of the side plates 13 and 13' constituting the box-shaped structural body 12 can be fully closed by joining the first front lower plate 17A and the lower joining plate 33F of the arm-side mounting member 33 constituting the different-thickness plate 18 and by joining the second front lower plate 17B and the third front lower plate 17C constituting the different-thickness plate 18.

Figure 12:
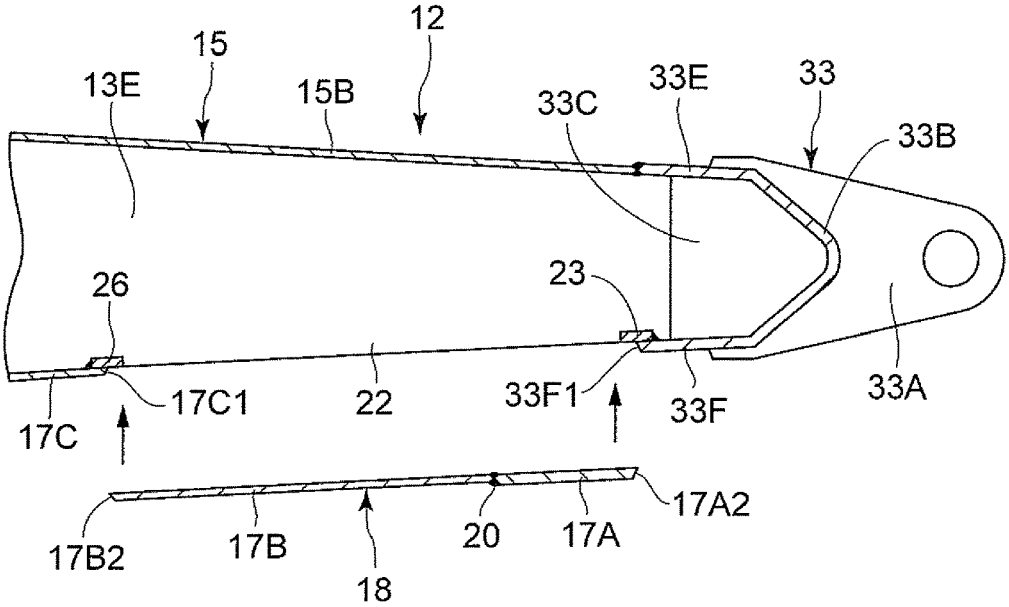
FIG. 12 is a sectional view showing a state in which the different-thickness plate is arranged between the lower joining plate of the arm-side mounting member and the third front lower plate.

In this case, as shown in FIG. 12, a backing material 23 is provided at a position on an inner side of the box-shaped structural body 12 on a rear end 33F1 of the lower joining plate 33F of the arm-side mounting member 33 which will be described later. This backing material 23 has a length dimension equal to an interval between each of the side plates 13 and 13' and is fixed to the rear end 33F1 of the lower joining plate 33F by welding in advance.

Figure 8:
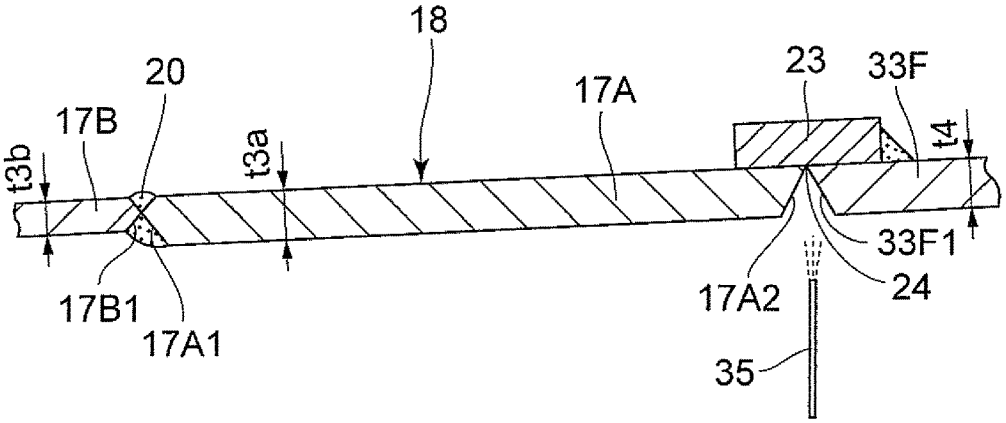
FIG. 8 is a sectional view showing a V-shaped groove between a front end of the first front lower plate and a lower joining plate of the arm-side mounting member constituting the different-thickness plate.
Figure 9:
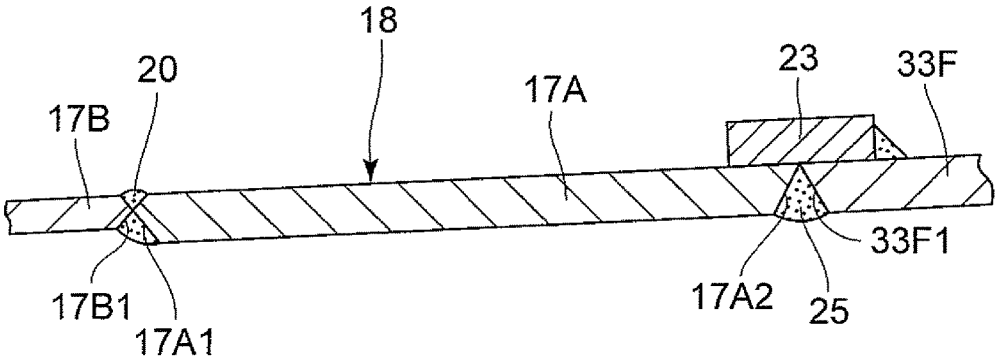
FIG. 9 is an enlarged sectional view showing an IX part in FIG. 6 in an enlarged manner.

As shown in FIG. 8, a V-shaped groove 24 inclined in a V-shape toward the backing material 23 is formed between a front end 17A2 of the first front lower plate 17A constituting the different-thickness plate 18 and the rear end 33F1 of the lower joining plate 33F constituting the arm-side mounting member 33. Accordingly, by performing one-side welding from the outer side of the box-shaped structural body 12 at a position of this V-shaped groove 24, the front end 17A2 of the first front lower plate 17A and the rear end 33F1 of the lower joining plate 33F of the arm-side mounting member 33 can be joined by a welding bead 25 (see FIG. 9).

On the other hand, as shown in FIG. 12, a backing material 26 is provided at a position on the inner side of the box-shaped structural body 12 on a front end 17C1 of the third front lower plate 17C. This backing material 26 has a length dimension equal to an interval between each of the side plates 13 and 13' and is fixed to the front end 17C1 of the third front lower plate 17C by welding in advance.

Figure 10:
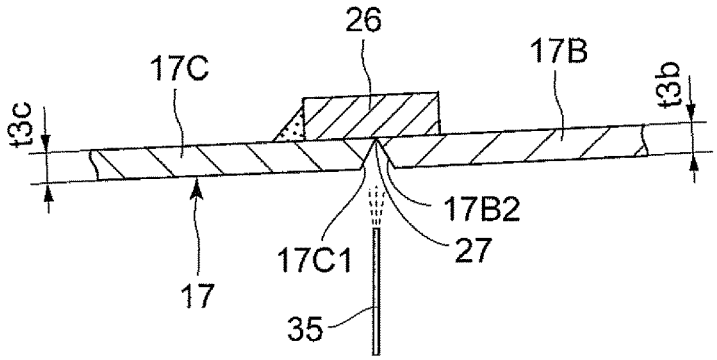
FIG. 10 is a sectional view showing the V-shaped groove between the rear end of the second front lower plate and the front end of the third front lower plate.
Figure 11:
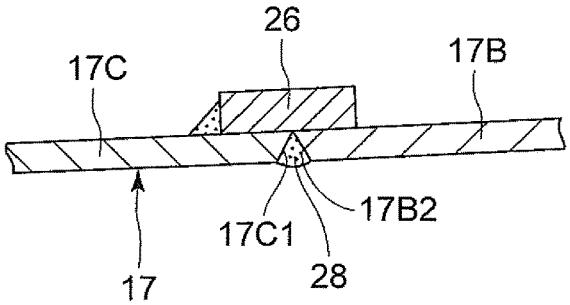
FIG. 11 is an enlarged sectional view showing an XI part in FIG. 6 in an enlarged manner.

As shown in FIG. 10, a V-shaped groove 27 inclined in a V-shape toward the backing material 26 is formed between a rear end 17B2 of the second front lower plate 17B constituting the different-thickness plate 18 and the front end 17C1 of the third front lower plate 17C. Accordingly, the rear end 17B2 of the second front lower plate 17B and the front end 17C1 of the third front lower plate 17C can be joined by a welding bead 28 (see FIG. 11) by performing one-side welding from the outer side of the box-shaped structural body 12 at a position of this V-shaped groove 27.

As shown in FIG. 3 and FIG. 4, a first partition plate 29 is provided inside the box-shaped structural body 12. This first partition plate 29 is joined to the second side plates 13B and 13B' constituting each of the side plates 13 and 13', the upper plate 15, and the lower plate 17. An upper end of the first partition plate 29 is joined to the intermediate upper plate 15C of the upper plate 15 by welding. A lower end of the first partition plate 29 is joined to the first rear lower plate 17D1 of the lower plate 17 by welding. A left end of the first partition plate 29 is joined to the second side plate 13B of the left side plate 13 by welding, and a right end of the first partition plate 29 is joined to the second side plate 13B' of the right side plate 13' by welding.

A second partition plate 30 is provided inside the box-shaped structural body 12 at a position on a front side of the first partition plate 29. This second partition plate 30 is joined to the fourth side plates 13D and 13D' constituting each of the side plates 13 and 13', the upper plate 15, and the lower plate 17. An upper end of the second partition plate 30 is joined to the intermediate upper plate 15C of the upper plate 15 by welding. A lower end of the second partition plate 30 is joined to the first rear lower plate 17D1 of the lower plate 17 by welding. A left end of the second partition plate 30 is joined to the fourth side plate 13D of the left side plate 13 by welding, and a right end of the second partition plate 30 is joined to the fourth side plate 13D' of the right side plate 13' by welding.

Next, constitutions of the foot-side mounting member 31, the cylinder mounting boss member 32, the arm-side mounting member 33, and the cylinder bracket 34 provided on the box-shaped structural body 12 will be explained.

The foot-side mounting member 31 is provided on the rear end side of the box-shaped structural body 12. This foot-side mounting member 31 is rotatably mounted on the revolving frame 4 of the hydraulic excavator 1 through a connecting pin (not shown). Here, the foot-side mounting member 31 is constituted by the cylindrical boss portion 31A extending in the left-right direction, a left joining plate 31B provided on a left end side of the boss portion 31A, and a right joining plate 31C provided on a right end side of the boss portion 31A. The left joining plate 31B of the foot-side mounting member 31 is joined to the rear end of the first side plate 13A constituting the left side plate 13 by welding, and the right joining plate 31C of the foot-side mounting member 31 is joined to the rear end of the first side plate 13A' constituting the right side plate 13' by welding. On the other hand, the rear end of the rear upper plate 15A constituting the upper plate 15 and the rear end of the third rear lower plate 17D3 constituting the lower plate 17 are joined to the boss portion 31A of the foot-side mounting member 31 by welding, respectively.

The cylinder mounting boss member 32 is provided in an intermediate part of the box-shaped structural body 12 in the length direction. A rod tip end of the boom cylinder 11A shown in FIG. 1 is rotatably connected to this cylinder mounting boss member 32 by a pin. Here, the cylinder mounting boss member 32 is constituted by a cylindrical boss portion 32A extending in the left-right direction, the left annular flange portion 32B provided on the left end side of the boss portion 32A, and a right annular flange portion 32C provided on the right end side of the boss portion 32A. The left annular flange portion 32B of the cylinder mounting boss member 32 is joined to a periphery of the punching hole 13C1 formed in the third side plate 13C constituting the left side plate 13 by welding, and the right annular flange portion 32C is joined to the periphery of a punching hole 13C1' formed in the third side plate 13C' constituting the right side plate 13' by welding.

Figure 6:
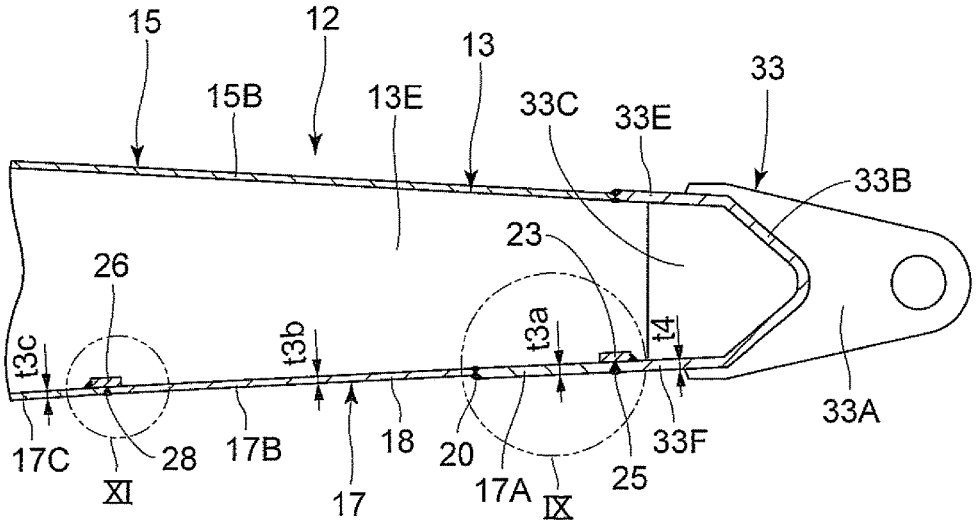
FIG. 6 is a sectional view showing a joined state of a lower joining plate of the arm-side mounting member and the first, second, and third front lower plates.

The arm-side mounting member 33 is provided on the front end of the box-shaped structural body 12. The base end side of the arm 9 shown in FIG. 1 is rotatably mounted through a connecting pin (not shown) to this arm-side mounting member 33. Here, the arm-side mounting member 33 is constituted by a pair of left and right bracket portions 33A forming a bifurcated shape and a joint portion 33B integrally connecting each of the bracket portions 33A to each other. The left joining plate 33C joined to the front end of the fifth side plate 13E constituting the left side plate 13 by welding, the right joining plate 33D joined to the front end of the fifth side plate 13E' constituting the right side plate 13' by welding, the upper joining plate 33E joined to the front end of the front upper plate 15B constituting the upper plate 15 by welding, and the lower joining plate 33F joined to the front end 17A2 of the first front lower plate 17A constituting the lower plate 17 by welding are provided on the joint portion 33B. In this case, as shown in FIG. 6 and FIG. 8, the plate thickness t4 of the lower joining plate 33F is set to a thickness equal to the plate thickness t3*a* of the first front lower plate 17A, and the backing material 23 is fixed to the rear end 33F1 of the lower joining plate 33F.

The cylinder bracket 34 is provided in the intermediate part in the length direction of the upper plate 15 constituting the box-shaped structural body 12. A bottom side of the arm cylinder 9A shown in FIG. 1 is rotatably connected by a pin to this cylinder bracket 34. Here, the cylinder bracket 34 is formed of a pair of plate bodies facing each other at an interval in the left-right direction and is joined to the upper surface side of the intermediate upper plate 15C constituting the upper plate 15 by welding.

The hydraulic excavator 1 according to this embodiment has the constitution as described above, and next, a manufacturing process of the boom 11 will be described with reference to FIG. 3 to FIG. 14.

Regarding the left side plate 13, the first side plate 13A and the second side plate 13B are butt-welded along the welding line 14A, and the second side plate 13B and the third side plate 13C are butt-welded along the welding line 14B. Moreover, the third side plate 13C and the fourth side plate 13D are butt-welded along the welding line 14C, and the fourth side plate 13D and the fifth side plate 13E are butt-welded along the welding line 14D. As a result, the left side plate 13 made by joining the first side plate 13A to the fifth side plate 13E by welding is formed.

Similarly to the above, also regarding the right side plate 13', the first side plate 13A' and the second side plate 13B' are welded along the welding line 14A', the second side plate 13B' and the third side plate 13C' are welded along the welding line 14B', the third side plate 13C' and the fourth side plate 13D' are welded along the welding line 14C', and the fourth side plate 13D' and the fifth side plate 13E' are butt-welded along the welding line 14D'. As a result, the right side plate 13' made by joining the first side plate 13A' to the fifth side plate 13E' by welding is formed.

Regarding the upper plate 15, the rear upper plate 15A and the intermediate upper plate 15C are butt-welded along the welding line 16A, and the intermediate upper plate 15C and the front upper plate 15B are butt-welded along the welding line 16B. In a state where the upper plate 15 made by joining the intermediate upper plate 15C between the rear upper plate 15A and the front upper plate 15B is formed, rolling process is performed to this upper plate 15. As a result, the rear upper plate 15A and the intermediate upper plate 15C are curved along the arc-shaped profile line on the upper end side of each of the side plates 13 and 13'.

Regarding the lower plate 17, rolling process is performed to the first rear lower plate 17D1 constituting the rear lower plate 17D. As a result, the first rear lower plate 17D1 is curved along the arc-shaped profile line on the lower end side of each of the side plates 13 and 13'.

Subsequently, in a state where the first and second partition plates 29 and 30 and the cylinder mounting boss member 32 are arranged between each of the side plates 13 and 13', the upper plate 15 is joined to the upper end side of each of the side plates 13 and 13' by welding. Moreover, on the upper surface side of the intermediate upper plate 15C constituting the upper plate 15, the cylinder bracket 34 is joined by welding.

Subsequently, the foot-side mounting member 31 is joined on the rear end sides of each of the side plates 13 and 13' and the upper plate 15. That is, the rear end of the first side plate 13A constituting the left side plate 13 is butt-welded to the left joining plate 31B of the foot-side mounting member 31, and the rear end of the first side plate 13A' constituting the right side plate 13' is butt-welded to the right joining plate 31C of the foot-side mounting member 31. Moreover, the rear end of the rear upper plate 15A constituting the upper plate 15 is welded to the boss portion 31A of the foot-side mounting member 31.

On the other hand, the arm-side mounting member 33 is joined to the front end sides of each of the side plates 13 and 13' and the upper plate 15. That is, the front end of the fifth side plate 13E constituting the left side plate 13 is butt-welded to the left joining plate 33C constituting the arm-side mounting member 33, and the front end of the fifth side plate 13E' constituting the right side plate 13' is butt-welded to the right joining plate 33D constituting the arm-side mounting member 33. Moreover, the front end of the front upper plate 15B constituting the upper plate 15 is butt-welded to the upper joining plate 33E constituting the arm-side mounting member 33.

As described above, in a state where the first and second partition plates 29 and 30, the foot-side mounting member 31, the cylinder mounting boss member 32, the arm-side mounting member 33, and the cylinder bracket 34 are assembled to each of the assembled side plates 13 and 13' and the upper plate 15, the lower plate 17 is joined to the lower end side of each of the side plates 13 and 13'.

First, the first rear lower plate 17D1 and the third front lower plate 17C are joined along the welding line 21A by butt-welding the rear end of the third front lower plate 17C to the front end of the first rear lower plate 17D1, and the lower end side of each of the side plates 13 and 13' assembled on the upper plate 15 is closed by the first rear lower plate 17D1 and the third front lower plate 17C.

Moreover, by butt-welding the front end of the second rear lower plate 17D2 to the rear end of the first rear lower plate 17D1, the second rear lower plate 17D2 and the first rear lower plate 17D1 are joined along the welding line 21B. Further, the front end of the third rear lower plate 17D3 is butt-welded to the rear end of the second rear lower plate 17D2, the third rear lower plate 17D3 and the second rear lower plate 17D2 are joined along the welding line 21C, and the rear end of the third rear lower plate 17D3 is joined to the boss portion 31A of the foot-side mounting member 31 by welding.

As described above, as shown in FIG. 5, the lower end side of each of the side plates 13 and 13' assembled on the upper plate 15 is closed by the rear lower plate 17D made of the first rear lower plate 17D1 to the third rear lower plate 17D3 and the third front lower plate 17C. In this state, the opening portion 22 is formed between the third front lower plate 17C and the lower joining plate 33F of the arm-side mounting member 33. In this case, the backing material 26 is provided in advance on the front end 17C1 of the third front lower plate 17C, and the backing material 23 is provided in advance on the rear end 33F1 of the lower joining plate 33F of the arm-side mounting member 33.

Subsequently, as shown in FIG. 7, the rear end 17A1 of the first front lower plate 17A and the front end 17B1 of the second front lower plate 17B are butt-welded so as to form the single different-thickness plate 18 with the front side made of the first front lower plate 17A and the rear side made of the second front lower plate 17B. In this case, the X-shaped groove 19 is formed between the rear end 17A1 of the first front lower plate 17A and the front end 17B1 of the second front lower plate 17B. Accordingly, the different-thickness plate 18 having large strength can be formed by performing double-side welding by using a welding torch 35 from both sides in the plate thickness direction at the position of this X-shaped groove 19.

Figure 13:
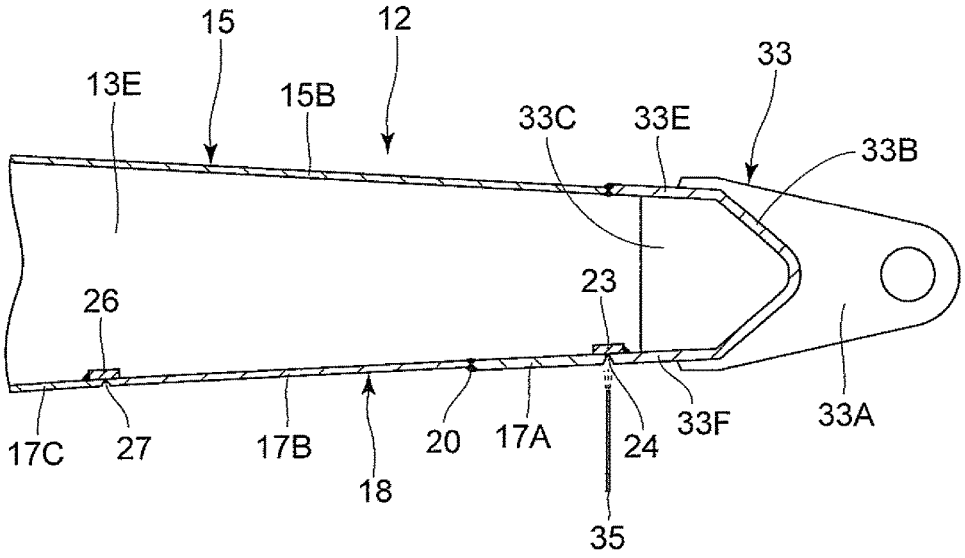
FIG. 13 is a sectional view showing a state in which the front end of the first front lower plate and the lower joining plate of the arm-side mounting member constituting the different-thickness plate are joined.
Figure 14:
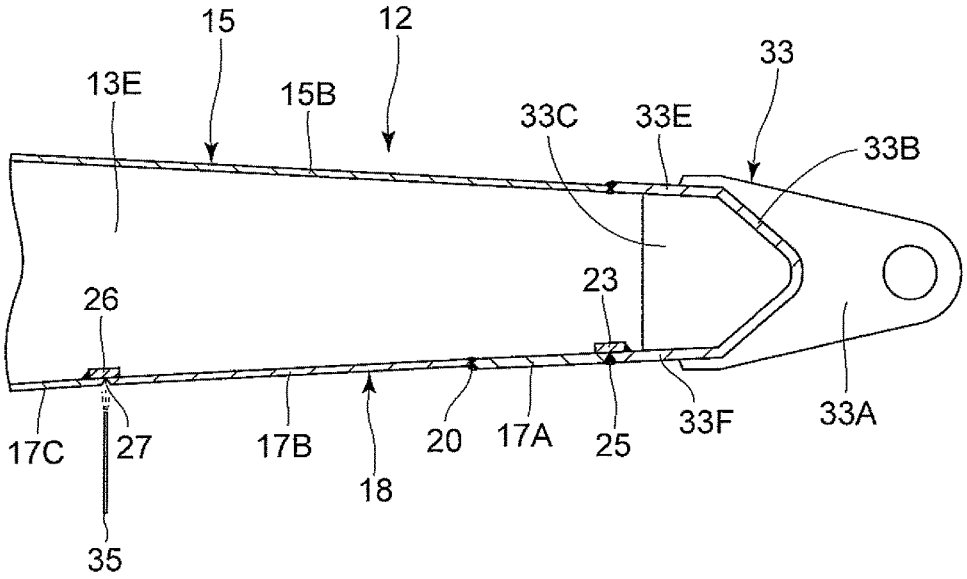
FIG. 14 is a sectional view showing a state in which the rear end of the second front lower plate and the front end of the third front lower plate constituting the different-thickness plate are joined.

Next, as shown in FIG. 12 to FIG. 14, the different-thickness plate 18 is joined by welding to the third front lower plate 17C joined to the lower end side of each of the side plates 13 and 13', and to the lower joining plate 33F of the arm-side mounting member 33. First, the front end 17A2 of the first front lower plate 17A constituting the different-thickness plate 18 is brought into contact with the backing material 23 provided on the lower joining plate 33F of the arm-side mounting member 33. In this state, one-side welding is performed to the front end 17A2 of the first front lower plate 17A and the rear end 33F1 of the lower joining plate 33F from the outer side of the box-shaped structural body 12.

In this case, as shown in FIG. 8, the plate thickness t3*a* of the first front lower plate 17A is set equal to the plate thickness t4 of the lower joining plate 33F, and the V-shaped groove 24 inclined in a V-shape toward the backing material 23 is formed between the front end 17A2 of the first front lower plate 17A and the rear end 33F1 of the lower joining plate 33F. Accordingly, welding at the position of this V-shaped groove 24 is performed by one-side welding using the welding torch 35 from the outer side of the box-shaped structural body 12. As a result, the front end 17A2 of the first front lower plate 17A and the rear end 33F1 of the lower joining plate 33F of the arm-side mounting member 33 can be firmly joined to each other by the welding bead 25 (see FIG. 9).

Subsequently, as shown in FIG. 14, the rear end 17B2 of the second front lower plate 17B constituting the different-thickness plate 18 is brought into contact with the backing material 26 provided on the third front lower plate 17C. In this state, butt-welding is performed to the rear end 17B2 of the second front lower plate 17B and to the front end 17C1 of the third front lower plate 17C from the outer side of the box-shaped structural body 12.

In this case, as shown in FIG. 10, the plate thickness t3*b* of the second front lower plate 17B and the plate thickness t3*c* of the third front lower plate 17C are set equal to each other. The V-shaped groove 27 inclined in a V-shape toward the backing material 26 is formed between the rear end 17B2 of the second front lower plate 17B and the front end 17C1 of the third front lower plate 17C. Accordingly, welding at a position of this V-shaped groove 27 is performed by one-side welding by using the welding torch 35 from the outer side of the box-shaped structural body 12. As a result, the rear end 17B2 of the second front lower plate 17B and the front end 17C1 of the third front lower plate 17C can be firmly joined to each other by the welding bead 28 (see FIG. 11).

As described above, the opening portion 22 between the third front lower plate 17C joined to the lower end side of each of the side plates 13 and 13' and the lower joining plate 33F of the arm-side mounting member 33 can be closed by the different-thickness plate 18, and the boom 11 having the box-shaped structural body 12 forming a closed sectional structure can be formed.

Thus, according to this embodiment, the X-shaped groove 19 is formed between the first front lower plate 17A having the plate thickness t3*a* equal to the plate thickness t4 of the lower joining plate 33F of the arm-side mounting member 33 and the second front lower plate 17B having the plate thickness t3*b* equal to the plate thickness t3*c* of the third front lower plate 17C. Thus, the single different-thickness plate 18 can be formed by performing double-side welding, the first front lower plate 17A and the second front lower plate 17B from both sides in the plate thickness direction at the position of the X-shaped groove 19 in advance at another place. Thus, in this embodiment, the first front lower plate 17A and the second front lower plate 17B are joined by full-welding in which they are welded over the entire region of the plate thickness, and the different-thickness plate 18 with high fatigue strength in the welded portion can be formed.

Moreover, the plate thickness t3*a* of the first front lower plate 17A constituting the different-thickness plate 18 is equal to the plate thickness t4 of the lower joining plate 33F of the arm-side mounting member 33. Thus, even in the case where the front end 17A2 of the first front lower plate 17A and the lower joining plate 33F of the arm-side mounting member 33 are one-side welded from the outer side by using the backing material 23, fatigue strength of the welded portion (welding bead 25) between the first front lower plate 17A and the lower joining plate 33F of the arm-side mounting member 33 can be improved. On the other hand, the plate thickness t3*b* of the second front lower plate 17B constituting the different-thickness plate 18 is equal to the plate thickness t3*c* of the third front lower plate 17C. Accordingly, even in the case where the rear end 17B2 of the second front lower plate 17B and the front end 17C1 of the third front lower plate 17C are one-side welded from the outer side by using the backing material 26, the fatigue strength of the welded portion (welding bead 28) between the second front lower plate 17B and the third front lower plate 17C can be improved.

Therefore, the first front lower plate 17A constituting the different-thickness plate 18 and the lower joining plate 33F of the arm-side mounting member 33 are one-side welded from the outer side by using the backing material 23. The second front lower plate 17B and the third front lower plate 17C constituting the different-thickness plate 18 are one-side welded from the outer side by using the backing material 23. As a result, fatigue strength of the entire box-shaped structural body 12 can be improved, and durability of the boom 11 can be improved.

Moreover, in this embodiment, the welding work to the first front lower plate 17A and the lower joining plate 33F and the welding work to the second front lower plate 17B and the third front lower plate 17C do not have to be performed in a narrow work space within the box-shaped structural body 12 with a forced work posture but can be performed with allowance outside the box-shaped structural body 12. As a result, a welding quality can be improved, and by reliably closing the box-shaped structural body 12 by the first and second front lower plates 17A and 17B, fatigue strength of the entire boom 11 can be improved. Moreover, workability can be improved when the first and second front lower plates 17A and 17B are welded.

Figure 15:
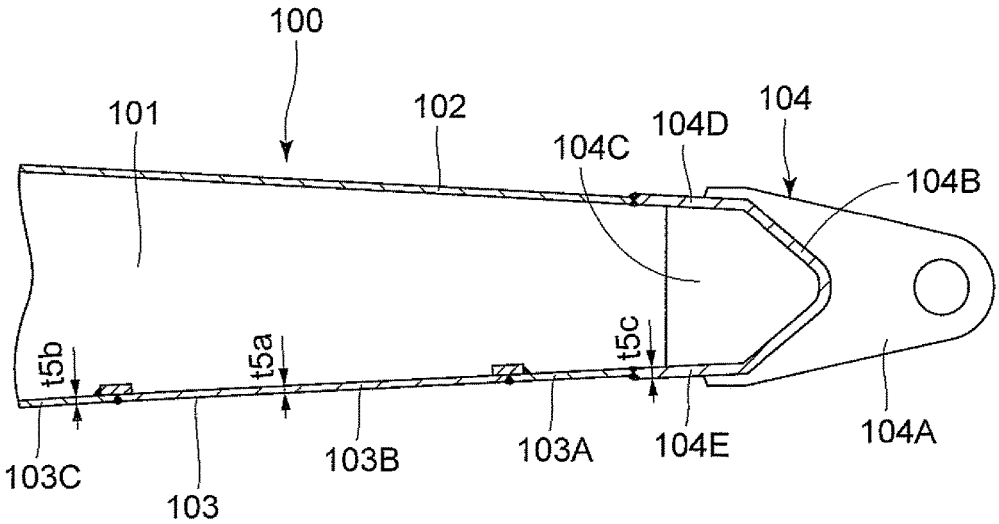
FIG. 15 is a sectional view showing a mutually joined state of the first, second, and third front lower plates according to a comparative example.
Figure 16:
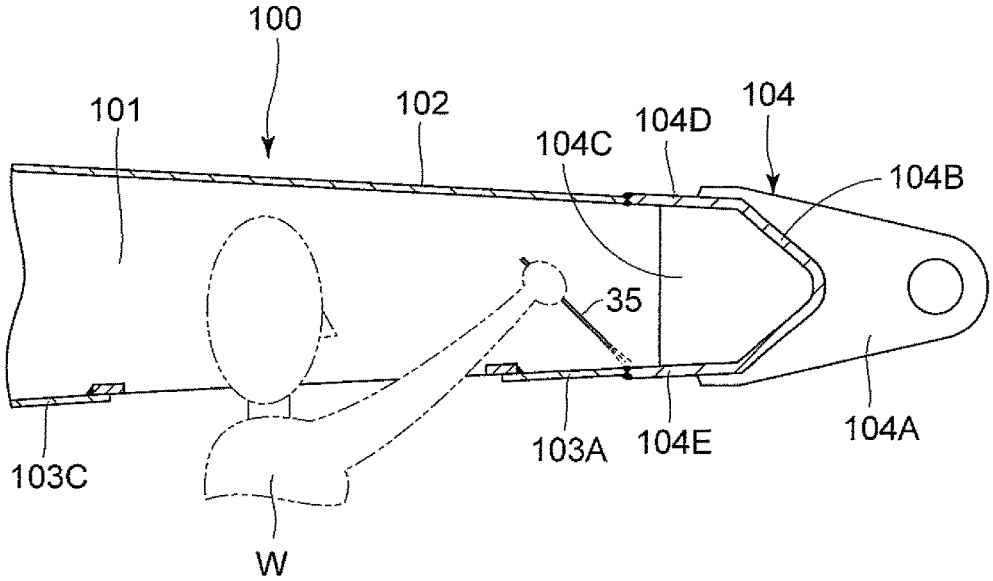
FIG. 16 is a sectional view showing a state of double-side welding of the first front lower plate to the lower joining plate of the arm-side mounting member according to the comparative example.

Next, comparison between the boom 11 according to this embodiment and a boom 100 according to a comparative example shown in FIG. 15 and FIG. 16 will be explained.

First, substantially similarly to the boom 11 according to this embodiment, the boom 100 according to the comparative example has left and right side plates 101 (only the left side is shown), an upper plate 102, a lower plate 103, and an arm-side mounting member 104.

Here, the lower plate 103 has a first front lower plate 103A, a second front lower plate 103B and a third front lower plate 103C in order from a front side (arm-side mounting member 104 side). The third front lower plate 103C is joined to a lower end side of the side plate 101 prior to the first and second front lower plates 103A and 103B. On the other hand, the arm-side mounting member 104 is made of a bracket portion 104A and a joint portion 104B, and the joint portion 104B has left and right joining plates 104C, an upper joining plate 104D, and a lower joining plate 104E. A plate thickness t5*a* of the first front lower plate 103A and the second front lower plate 103B is equal to a plate thickness t5*b* of the third front lower plate 103C and is set smaller than a plate thickness t5*c* of the lower joining plate 104E of the arm-side mounting member 104 ($t5a=t5b<t5c$).

In this case, the plate thickness t5*a* of the first front lower plate 103A is smaller than the plate thickness t5*c* of the lower joining plate 104E of the arm-side mounting member 104. Thus, in the case where one-side welding is performed by using the backing material to the first front lower plate 103A and the lower joining plate 104E of the arm-side mounting member 104, fatigue strength of the welded portion lowers. Thus, in the comparative example, double-side welding can be considered to be performed to the first front lower plate 103A and the lower joining plate 104E of the arm-side mounting member 104 in order to improve the fatigue strength of the welded portion.

Thus, double-side welding is performed to the rear end of the lower joining plate 104E of the arm-side mounting member 104 and the front end of the first front lower plate 103A. At this time, as shown in FIG. 16, a worker W needs to perform a welding work in a forced work posture within a narrow space surrounded by the left and right side plates 101 and the upper plate 102, and visibility to the welded portion lowers. As a result, not only that the workability of the welding work is poor but also the welding quality of the welded portion between the lower joining plate 104E of the arm-side mounting member 104 and the first front lower plate 103A lowers which also lowers the fatigue strength, and there is a concern that durability of the boom 100 lowers.

On the other hand, according to the boom 11 according to this embodiment, regarding the first front lower plate 17A and the second front lower plate 17B, welding is not directly performed to the boom 11 but the single different-thickness plate 18 is formed by performing double-side welding from both sides in the plate thickness direction in advance. As a result, the plate thickness t3*a* of the first front lower plate 17A constituting the different-thickness plate 18 and the plate thickness t4 of the lower joining plate 33F of the arm-side mounting member 33 can be made equal to each other, and the plate thickness t3*b* of the second front lower plate 17B constituting the different-thickness plate 18 and the plate thickness t3*c* of the third front lower plate 17C can be made equal to each other. Accordingly, the front end 17A2 of the first front lower plate 17A and the lower joining plate 33F of the arm-side mounting member 33 can be firmly joined by one-side welding using the backing material 23 from the outer side of the box-shaped structural body 12. Moreover, the rear end 17B2 of the second front lower plate 17B and the front end 17C1 of the third front lower plate 17C can be firmly welded by one-side welding using the backing material 26 from the outer side of the box-shaped structural body 12. As a result, fatigue strength of the entire box-shaped structural body 12 can be improved, and durability of the boom 11 can be improved.

Moreover, the work of butt-welding of the first front lower plate 17A constituting the different-thickness plate 18 and the lower joining plate 33F of the arm-side mounting member 33 and the work of butt-welding of the second front lower plate 17B constituting the different-thickness plate 18 and the third front lower plate 17C can be performed by one-side welding from the outer side of the box-shaped structural body 12. As a result, workability can be improved when the first and second front lower plates 17A and 17B are welded.

It should be noted that, in the aforementioned embodiment, the case where the rear lower plate 17D constituting the lower plate 17 together with the first front lower plate 17A to the third front lower plate 17C is formed by using three plate materials of the first rear lower plate 17D1, the second rear lower plate 17D2, and the third rear lower plate 17D3 is exemplified. However, the present invention is not limited thereto, but the rear lower plate may be formed by using one to two plate materials or four or more plate materials, for example.

Moreover, in the aforementioned embodiment, the case where the left side plate 13 is formed by using five plate materials of the first side plate 13A to the fifth side plate 13E and the right side plate 13' is formed by using five plate materials of the first side plate 13A' to the fifth side plate 13E' is exemplified. However, the present invention is not limited thereto, but the left and right side plates may be formed by using one to four plate materials or six or more plate materials, for example.

Similarly to the above, in the aforementioned embodiment, the case where the upper plate 15 is formed by using three plate materials of the rear upper plate 15A, the front upper plate 15B, and the intermediate upper plate 15C is exemplified. However, the present invention is not limited thereto, but the upper plate may be formed by using one to two plate materials or four or more plate materials, for example.

Moreover, in the aforementioned embodiment, the boom 11 used in the crawler-type hydraulic excavator 1 is explained as a typical example of a construction machine. However, the present invention is not limited thereto, but may be widely applied to a boom used in other construction machines such as a wheel-type hydraulic excavator and the like, for example.

DESCRIPTION OF REFERENCE NUMERALS

1: Hydraulic excavator (Construction machine)
11: Boom
13: Left side plate
13': Right side plate
15: Upper plate
17: Lower plate
17A: First front lower plate
17A1, 17B2, 33F1: Rear end
17A2, 17B1, 17C1: Front end
17B: Second front lower plate
17C: Third front lower plate
17D: Rear lower plate
18: Different-thickness plate
19: X-shaped groove
23, 26: Backing material
24, 27: V-shaped groove
31: Foot-side mounting member
33: Arm-side mounting member
33C: Left joining plate
33D: Right joining plate
33E: Upper joining plate
33F: Lower joining plate

The invention claimed is:

1. A boom for a construction machine provided on a vehicle body of said construction machine comprising:

a box-shaped structural body formed of a cross section forming a square closed sectional structure by a left side plate and a right side plate facing each other at an interval in a left-right direction and extending in a front-rear direction, an upper plate joined to upper end sides of said left and right side plates by welding, and a lower plate joined to lower end sides of said left and right side plates by welding, and having a foot-side mounting member provided on said vehicle body in a rear end side and an arm-side mounting member provided on said arm in a front end side; wherein said foot-side mounting member is joined to rear ends of said left side plate, said right side plate, said upper plate, and said lower plate of said box-shaped structural body by welding, respectively, said arm-side mounting member has left and right joining plates to which front ends of said left and right side plates of said box-shaped structural body are joined by welding, respectively, and has upper and lower joining plates to which front ends of said upper plate and said lower plate are joined by welding, respectively, and said lower plate is constituted by a first front lower plate joined to said lower joining plate of said arm-side mounting member by welding, a second front lower plate joined to a rear end of said first front lower plate by welding, a third front lower plate joined to a rear end of said second front lower plate by welding, and a rear lower plate made of one or a plurality of plate materials joined to a rear end of said third front lower plate, said first front lower plate is made of a plate material having a plate thickness equal to said lower joining plate of said arm-side mounting member, said second front lower plate is made of a plate material having a plate thickness equal to said third front lower plate and having a plate thickness smaller than said first front lower plate, an X-shaped groove is formed between said rear end of said first front lower plate and said front end of said second front lower plate having a plate thickness smaller than said first front lower plate, and a single different-thickness plate is formed by the double-side welding performed to said X-shaped groove from both sides in the plate thickness direction, a first backing material is provided on a rear end of said lower joining plate of said arm-side mounting member, a second backing material is provided on a front end of said third front lower plate, a first V-shaped groove is formed between a front end of said first front lower plate constituting said different-thickness plate and a rear end of said lower joining plate of said arm-side mounting member having a plate thickness equal to said first front lower plate toward said first backing material, and joined from an outer side of said box-shaped structural body by one-side welding at the position of said first V-shaped groove, and a second V-shaped groove is formed between said rear end of said second front lower plate constituting said different-thickness plate and said front end of said third front lower plate having a plate thickness equal to said second front lower plate toward said second backing material, and joined from the outer side of said box-shaped structural body by one-side welding at the position of said second V-shaped groove.

* * * * *